US010017291B2

(12) United States Patent
Smith et al.

(10) Patent No.: US 10,017,291 B2
(45) Date of Patent: Jul. 10, 2018

(54) CHILD RESISTANT LOCKING PACKAGING

(71) Applicant: Multi Packaging Solutions, Inc., Lansing, MI (US)

(72) Inventors: Daniel T. Smith, Battle Creek, MI (US); Richard C. Thibault, Westchester, PA (US)

(73) Assignee: Multi Packaging Solutions, Inc., Lansing, MI (US)

( * ) Notice: Subject to any disclaimer, the term of this patent is extended or adjusted under 35 U.S.C. 154(b) by 0 days.

(21) Appl. No.: 15/142,195

(22) Filed: Apr. 29, 2016

(65) Prior Publication Data

US 2016/0325873 A1 Nov. 10, 2016

Related U.S. Application Data

(60) Provisional application No. 62/156,566, filed on May 4, 2015.

(51) Int. Cl.

| | |
|---|---|
| ***B65D 5/38*** | (2006.01) |
| ***B65D 79/00*** | (2006.01) |
| ***B65D 5/72*** | (2006.01) |
| ***A61J 1/00*** | (2006.01) |
| ***B65D 5/42*** | (2006.01) |

(52) U.S. Cl.
CPC *B65D 5/38* (2013.01); *A61J 1/00* (2013.01); *B65D 5/4266* (2013.01); *B65D 5/725* (2013.01); *B65D 5/728* (2013.01); *B65D 79/00* (2013.01); *B65D 2215/02* (2013.01)

(58) Field of Classification Search
CPC ..... B65D 5/38; B65D 5/4266; B65D 5/725; B65D 5/728; B65D 79/00; A61J 1/00
USPC ..... 206/242–276, 1.5; 229/125.125
See application file for complete search history.

(56) References Cited

U.S. PATENT DOCUMENTS

| | | | | |
|---|---|---|---|---|
| 5,323,907 | A | 6/1994 | Kalvelage | |
| 5,673,796 | A * | 10/1997 | Tulloch | B65D 5/38 206/459.5 |
| 6,047,829 | A * | 4/2000 | Johnstone | B65D 5/38 206/1.5 |
| 6,491,211 | B1 | 12/2002 | Evans et al. | |
| 6,955,290 | B2 | 10/2005 | Wende | |
| 7,090,079 | B2 * | 8/2006 | Ehrlund | B65D 83/0463 206/1.5 |
| 7,845,496 | B2 * | 12/2010 | Hession | B65D 5/38 206/528 |
| 7,932,563 | B2 * | 4/2011 | Ho | H01L 21/823807 257/365 |

(Continued)

FOREIGN PATENT DOCUMENTS

| | | |
|---|---|---|
| WO | 2011/154822 A1 | 12/2011 |
| WO | 2012/112538 A1 | 8/2012 |
| WO | 2013/164372 A1 | 11/2013 |

OTHER PUBLICATIONS

Extended European Search Report dated Sep. 12, 2016; Application No. EP16168324.8 (1523.068EP).

*Primary Examiner* — Chun Cheung
(74) *Attorney, Agent, or Firm* — The Dobrusin Law Firm, P.C.

(57) ABSTRACT

A container comprising an outer casing and an inner casing. The inner casing is received within the outer casing and is retractable from the outer casing. The inner casing includes a locking tab which engages with a locking layer of the outer housing.

19 Claims, 5 Drawing Sheets

(56) References Cited

U.S. PATENT DOCUMENTS

| | | | | |
|---|---|---|---|---|
| 8,342,330 | B2 * | 1/2013 | Weston | B65D 83/0463 206/1.5 |
| 8,499,936 | B2 * | 8/2013 | Albrecht | B65D 83/0463 206/528 |
| 8,746,540 | B2 | 6/2014 | Hultberg et al. | |
| 8,827,145 | B2 | 9/2014 | Hultberg et al. | |
| 9,487,338 | B2 | 11/2016 | Hammond et al. | |
| 9,668,937 | B2 | 6/2017 | Hammond et al. | |
| 2008/0047852 | A1 * | 2/2008 | Ghini | B65D 85/1063 206/268 |
| 2010/0176010 | A1 * | 7/2010 | Tearle | B65D 85/1036 206/256 |
| 2011/0062037 | A1 * | 3/2011 | Bertuzzi | B65B 61/20 206/267 |
| 2011/0163156 | A1 * | 7/2011 | Smith | B65D 83/0463 229/125.125 |
| 2015/0245980 | A1 | 9/2015 | Johnston et al. | |
| 2016/0120744 | A1 | 5/2016 | Hammond et al. | |
| 2016/0120745 | A1 | 5/2016 | Hammond et al. | |
| 2016/0120746 | A1 | 5/2016 | Hammond et al. | |
| 2016/0120747 | A1 | 5/2016 | Hammond et al. | |
| 2016/0120748 | A1 | 5/2016 | Hammond et al. | |
| 2016/0122102 | A1 | 5/2016 | Hammond et al. | |
| 2016/0122105 | A1 | 5/2016 | Hammond et al. | |
| 2016/0122106 | A1 | 5/2016 | Hammond et al. | |

* cited by examiner

CHILD RESISTANT LOCKING PACKAGING

FIELD OF INVENTION

The present disclosure relates to packaging which is elderly friendly and includes child resistant features. The packaging may find particular benefit in the pharmaceutical industry for the retaining and dispensing of medications.

BACKGROUND

There is a continuous need for packaging which stores and dispenses pharmaceutical products, such as medications. As children may be attracted to packaging of medications, most pharmaceutical packaging uses a child resistant or child proof feature. Many child resistant features may be found difficult to overcome by the medication's intended user due to limited hand use. Limited hand use may be suffered by elderly individuals or other afflictions which may impact hand use or dexterity, such as arthritis. As such, there is a need for packaging that deters children from accessing the contents contained within the packaging, but yet may be convenient to access for persons having limited use of their hands.

U.S. Pat. No. 8,746,540 discloses child resistant packaging intended for pharmaceuticals. The packaging provides for an inner casing that is able to retract within an outer casing. The inner case is provided with a raise edge that engages with a corresponding raised edge located on the inside surface of the outer casing and requires beings depressed to disengage the inner casing from the outer casing. The packaging further includes flaps which will rupture and release fragments of the box is tampered with. There is no disclosure relating to the ease of use of the packaging by an individual with limited hand use.

U.S. Pat. No. 8,827,145 discloses packaging with an inner and outer casing which may be used for carrying objects such as chewing gums comprising nicotine. The packaging includes a means of tamper evidence at a weakening line. To provide child resistant access, the packaging includes a lock member in which a raised edge is located on an outside wall of inner casing which engaged with a raised edge on the inside of the outer casing. To disengage the inner member from the outer member, the raised edge of the inner member is depressed thereby loosening engagement with the outer casing. There is no disclosure relating to the ease of use of the packaging by an individual with limited hand use.

U.S. Pat. No. 6,955,290 discloses packaging formed of a single blank having an outer contour unit and an inner contour unit suitable for retaining pharmaceuticals, such as pills. The inner contour unit may be displaced within the outer contour unit by a connecting folding tab capable of either folding a stretching. The material contained within the packaging may be removed from a removal opening in the inner contour unit. There is no teaching provided for tamper proofing the packaging or making the packaging child resistant.

There remains a need for packaging which is child resistant, to deter children from accessing the contents within the packaging, and simple enough to use for an individual with limited hand use. There remains a need from packaging that can be constructed from as few products as possible. There remains a need for packaging which may initially be formed in a flat, one-dimensional configuration and then formed into a three-dimensional configuration.

SUMMARY OF INVENTION

The present disclosure relates to a container comprising: an outer casing, an inner casing which is received within the outer casing and retractable from the outer casing, wherein the inner casing includes a locking tab which engages with a locking layer of the outer casing.

In some preferred embodiments, the container of the disclosure includes at least one continuous sheet to form the inner and/or outer casing. In some preferred embodiments, the container of the disclosure includes a plurality of fold lines to guide assembly of the continuous sheet(s). In some preferred embodiments, the inner casing includes a dispense aperture. In some preferred embodiments, container of the disclosure includes a plurality of closure flaps located on the inner casing and/or outer casing. In some preferred embodiments, the container of the disclosure contains pharmaceutical products. In some preferred embodiments, the container of the disclosure contains medicated chewing gum.

The teachings herein provide a method of using the container described herein, and also a method of assembling the article described herein.

The article of the disclosure provides a container with features that may deter a child from accessing the contents within the container. The article of the disclosure provides a container with features that may make it convenient for an individual with limited hand use or dexterity to open the container. The article of the disclosure provides a container which may be formed from a flat blank.

DETAILED DESCRIPTION

Figure 1:
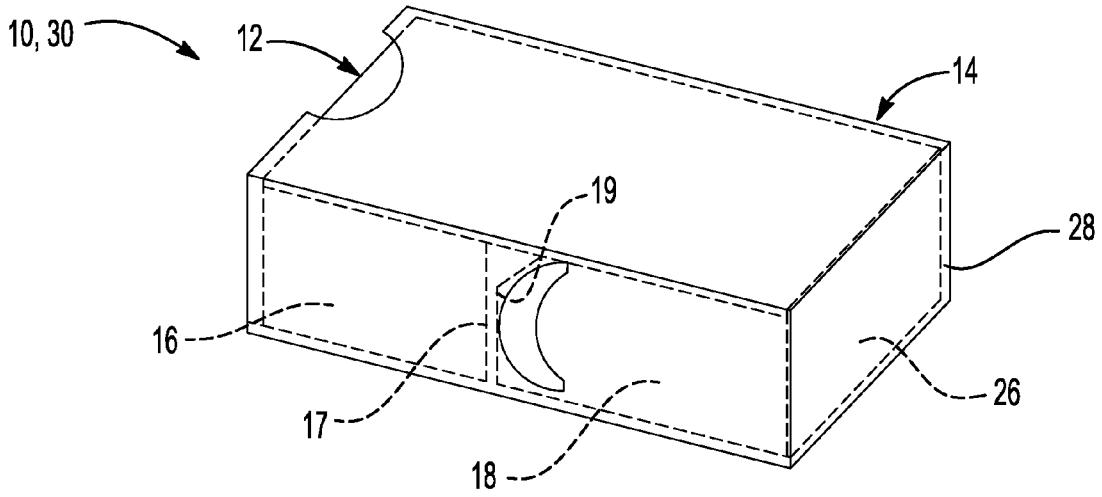
FIG. 1 is an isometric view of a container in accordance with the present teachings.

The explanations and illustrations presented herein are intended to acquaint others skilled in the art with the invention, its principles, and its practical application. The specific embodiments of the present invention as set forth are not intended as being exhaustive or limiting of the invention. The scope of the invention should be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

This application claims the benefit of the filing date of U.S. Provisional Application No. 62/156,566, filed May 4, 2015, the entirety of the contents of this application being hereby incorporated by reference for all purposes.

The disclosure relates to a container comprising one or more casings. Each casing of the container may have a flat, one-dimensional configuration and a second, three-dimensional configuration. The casings may transition to and from the first configuration to the second configuration through folding and/or unfolding.

The container according to the teachings herein may be configured to receive and/or dispense one or more items for retail purposes, for storage purposes, for transportation purposes, or for any combination thereof. The container may find particular use in the receiving and/or dispensing of pharmaceutical products, including tablets and medicated gum, such as nicotine gum.

The disclosure relates to a container which comprises an outer casing. The container further comprises an inner casing which is received within the outer casing and is retractable from the outer casing. The inner casing includes a locking tab which engages with a locking layer of the outer casing.

The container of the disclosure may further comprise any one or more of the features described in this specification in any combination, including preferences and examples listed in this specification, and including the following features: the outer casing may be formed of a first single continuous sheet, and the inner casing may be formed of a second single continuous sheet; the first and second continuous sheet may each include a plurality of fold lines; the second continuous sheet may be divided into a plurality of panels by a plurality of fold lines; the first continuous sheet may be divided into a plurality of panels by a plurality of fold lines; the inner casing may include a plurality of surfaces, which may include a top surface and a bottom surface connected by a plurality of side walls and the top surface, the bottom surface, and the plurality of side walls may each be formed by a panel of the second continuous sheet; the outer casing may include a plurality of surfaces, which may include a top surface and a bottom surface connected by a plurality of side walls and the top surface, the bottom surface, and the plurality of side walls may each be formed by a panel of the first continuous sheet; the inner casing may include a dispense aperture formed in one of the side walls which may allow material within the inner casing to be dispensed; one of the panels may be a locking tab and the locking tab may be hingedly connected at a fold line of the second continuous sheet to a surface of the inner casing; one of the panels may be located in the inside of the outer casing and may be in planar contact with one of the surfaces to form the locking layer; the outer casing may include at least one access contour on at least one of its surfaces which may provide access to the inner casing when it is retained within the outer casing; when the inner casing is fully retracted within the outer casing, the inner casing locking tab may engage with the outer casing locking layer; the outer casing may include an unlock surface located on at least of its surfaces which may disengage the locking tab from the locking layer; the unlock surface may be pressed to disengage the locking tab from the locking layer; at least one surface of the inner casing may include perforations which may allow a section of the inner casing to be removed to form the dispense aperture; the inner casing may include a plurality closure flaps which may be formed by panels of the second continuous sheet; the outer casing may include a plurality of closure flaps which may be formed by panels of the first continuous sheet; the container may comprise an adhesive on one or more panels to maintain the inner casing and outer casing in closed configurations; the inner casing may contain pharmaceutical products; and pharmaceutical products may be medicated chewing gum.

The container of the disclosure may comprise an outer casing. The outer casing may be generally rectangular or any other shape suitable for containing small products. The outer casing may have a plurality of surfaces. The outer casing may include a top surface, a bottom surface, and a plurality of side walls. The top surface and bottom surface may be substantially planar. The top surface may be distanced from and parallel to the bottom surface. The bottom surface and the top surface may each include a plurality of peripheral edges along their perimeters. One or more side walls may be substantially planar. One or more side walls may include lateral edges. The outer casing may have lateral side walls. A pair of lateral side walls may project orthogonally from peripheral edges of both the top surface and the bottom surface. The pair of lateral side walls may be distanced from and parallel to one another. The lateral side edges of the lateral side walls may extend from the top surface to the bottom surface. The outer casing may include a back end and a front end. The back end may include a back side wall which projects orthogonally from a peripheral edge of the top surface to a peripheral edge of the bottom surface. The back side wall may be adjacent to the pair of lateral side walls. The lateral side edges of the lateral side walls may extend from the top surface to the bottom surface. The lateral edges of the back side wall may be adjacent to the lateral edges of the lateral side walls. The lateral edges of the back side wall may be the same as the lateral edges of the lateral side walls. The outer casing may have an end that is free of any type of surface, such as the front end. The outer casing may have a hollow interior. An end, such as the front end, may provide access to the hollow interior. The surfaces of the outer casing may have interior faces facing toward the hollow interior and exterior faces that are exposed. The exposed faces may be the outer casing's show surface. The outer casing may include surfaces comprised of, or at least partially comprised of, more than one layer of material. The outer casing may have a height, defined as the distance from the top surface to the bottom surface. The outer casing may have a width, defined as distance between the pair of opposing side walls. The outer casing may have a length, defined as the distance from the back end of the outer casing to the front end.

The container of the disclosure may comprise an inner casing. The inner casing may be generally rectangular or any other shape suitable for containing small products. The inner casing may have a plurality of surfaces. The inner casing may include a top surface, a bottom surface, and a plurality of side walls. The top surface and bottom surface may be substantially planar. The top surface may be distanced to and parallel from the bottom surface. The bottom surface and the top surface may each include a plurality of peripheral edges along their perimeters. The inner casing may include side walls around its entire perimeter. One or more side walls may be substantially planar. One or more side walls may include lateral edges. The inner casing may have lateral side walls. A pair of lateral side walls may project orthogonally from peripheral edges of the bottom surface to peripheral edges of the top surface. The pair of lateral side walls may be distanced from and parallel to one another. The lateral side edges of the lateral side walls may extend from the top surface to the bottom surface. The inner casing may include a front end and a back end. The inner casing may have a pair of fore-aft side walls. The fore-aft side walls may project orthogonally from peripheral edges of the bottom surface to peripheral edges of the top surface. The fore-aft side walls may be distanced from and parallel to one another. One of the fore-aft side walls may define the front end of the inner casing. The fore-aft side wall at the front end of the inner casing may be the front side wall. An opposing fore-aft side wall may define the back end of the inner casing. The fore-aft side wall at the back end of the inner casing may be the back side wall. The lateral edges of the front side wall and/or back side wall may be adjacent to the lateral edges of the lateral side walls. The lateral edges of the front side wall and/or back side wall may be the same as the lateral edges of the lateral side walls. The inner casing may have a hollow interior. The surfaces of the inner casing may have interior faces facing toward the hollow interior and exterior faces that are exposed. The exposed surfaces may be a show surfaces. The interior surfaces may be suitable for being in direct contact with pharmaceutical products. The surfaces of the inner casing may include surfaces comprised of, or at least partially comprised of, more than one layer of material. The inner casing may have a height, defined as the distanced from the top surface to the bottom surface. The inner casing may have a length, defined as the distance from the front end to the back end. The inner casing may have a width, defined as the distance from one lateral side wall to an opposing lateral side wall. The inner casing may be sized such that it fits within the outer casing. The inner casing may be sized such that it is retractable from the outer casing. The height of the inner casing may be less the height of the outer casing. The width of the inner casing may be less than the width of the outer casing. The length of the inner casing may be less than, equal to, or greater than the length of the outer casing.

Each casing of the container may comprise a blank. The blank may be a continuous sheet. Only one blank may be needed per casing. The blank may include a plurality of fold lines. The blank, prior to folding along the fold lines, may be initially flat. The blank's flat configuration may be a casing's one-dimensional configuration. The blank may be folded along the fold lines to form a casing's three-dimensional configuration. The blank may include an exterior facing surface. The blank may include an interior facing surface. The fold lines may divide the blank into panels. When the blank is folded, the panels may form all or part of a casing's surfaces and/or walls. The panels may form other features of the casing, such as locking features, retention features, closing features, or a combination thereof.

A blank for each casing may include regions having creases, regions having slits, regions having perforations, or any combination thereof. Creases preferably are employed in areas that provide a structural feature, such as a connection between two adjacent side walls or where a side wall meets a top or bottom surface. Creases are also preferably employed to allow easy folding, defined folding, or both in regions that will be visible in the individual assembled casings or overall container. Preferably, the assembled container is free of visible slits or perforations. Perforations and/or slits preferably are employed for folding in regions that are not visible in the assembled container and may not be required to provide a structure between the areas on either side of the fold. Creases, slits, perforations, and the combination thereof may be referred to as fold lines.

The container may comprise one or more dispense apertures. The dispense aperture may be located on a surface of the inner casing and/or a surface of the outer casing. Preferably, the dispense aperture is on a surface of the inner casing. The dispense aperture may be sized to allow material contained within the inner casing to be dispensed from the inner casing. For example, if tablets or chewing gum are stored within the inner casing, the dispense aperture may be sized larger than the tablets or chewing gum. The dispense aperture may be formed by removing a perforated portion from the casing. For example, a perforated pattern, such as an oval or circle, may be located on a surface of the casing. A user may then apply force to the perforated surface, such as pressing down on the surface, thereby piercing the perforations which allows a portion of the surface to be removed and thereby creating the dispense aperture. The dispense aperture may be located on a side wall, top surface, bottom surface, or combination thereof of the inner casing. The dispense aperture may be placed along the length of the inner casing, such that it is not exposed when the inner casing is fully retracted within the outer casing. For example, when the container is in the closed configuration, the outer casing blocks access to the dispense aperture or prevents the materials stored within the inner casing from falling out. A dispense aperture may be located on both the inner casing and outer casing. The dispense apertures may be offset from one another when the container is in the closed configuration, such that a surface of the outer casing blocks an aperture of the outer casing, and the aperture in the outer casing only exposes an exterior surface of the inner casing. The inner casing may be withdrawn from the outer causing such that the aperture in the inner casing aligns with an aperture in the outer casing, thereby allowing the materials contained within the inner casing to be dispensed.

The inner casing may include a locking tab. The locking tab may be any feature that engages with a feature of the outer casing to prevent the inner casing from being withdrawn from the outer casing. The locking tab may be any feature that deters a child from removing the inner casing from the outer casing. The locking tab may be a panel of the continuous sheet or blank used to form the inner casing. The locking tab may be located on any surface of the inner casing, such as the top surface, bottom surface, side wall, or a combination thereof. The locking tab may be located on any surface's exterior of the inner casing. The locking tab may be a projection from any surface of the inner casing, such as the top surface, bottom surface, side wall, or combination thereof. The locking tab may be integrally connected to any surface or panel of the inner casing. The locking tab may be integrally connected via a fold line such that it is hingedly connected to a surface of the casing. The fold line may allow the locking tab to fold into planar contact with an adjacent surface. For example, the locking tab may project from the top surface of the inner casing at a fold line, which allows the locking tab to fold down into planar contact with a side wall of the inner casing. The locking tab may have a back end and a front end. The back end may be close to the back end of the inner casing than the front end. The locking tab may have a length defined as the distance from its back end to its front end. The locking tab may have any length that allows it to engage with a feature of the outer casing.

The outer casing may include a locking layer. The locking layer may be any feature located within the interior of the outer casing that retains the inner casing retracted within the outer casing. The locking layer may be any feature that engages with a feature of the inner casing, such as the locking tab, to prevent the inner casing from being withdrawn from the outer casing. The locking layer may be any feature that engages with a feature of the inner casing to deter a child from removing the inner casing from the outer casing. For example, the locking layer may engage with the locking tab of the inner casing. The locking layer may be a lateral projection from any surface of the outer casing, for example the locking layer may project from the top surface, bottom surface, side wall, or combination thereof. The locking layer may be integrally connected to a surface of the outer casing, such as by a fold line. The locking layer may be comprised of a panel of the blank which forms the outer casing. The locking layer may be any material which may form at least one additional layer in the interior of the outer casing. For example, if the locking layer is a lateral projection or panel, it may fold inward into the inside of the outer casing. The lateral projection or panel may then be adhered, such as with an adhesive, into planar contact with an interior surface of side or panel of the outer casing. The locking layer may have a front end and a back end. The front end may be where the locking layer is integrally connected at the fold line to a surface of the outer casing or the end of the locking layer closest to the front end of the outer casing. The back end may be the end of the locking layer opposing the front end. The locking layer may have a length defined as the distance between the front end and the back end. The locking layer may have a length such that when the inner casing is fully retracted within the outer casing, the back end of the locking layer may be distanced from the front end of the locking tab or the back end of the locking layer may be adjacent and in contact with the front end of the locking tab, preferably the locking tab is not overlapping with the locking layer. When the inner casing is fully retracted within the outer casing, the back end's exterior surface may be adjacent and in contact with the outer casing's back end interior surface. The locking layer may prevent the inner casing from being withdrawn from the casing by impeding movement of the locking tab. For example, the back end of the locking layer may block forward movement of the locking tab, thereby preventing forward movement of the inner casing.

The container may comprise a lock disengagement. The lock disengagement may be any feature or combination of features in the outer and/or inner casing that allows the locking tab to overcome the locking layer. The lock disengagement may by any feature that allows the inner casing to be withdrawn from the outer casing. The lock disengagement may be any feature that may be simple to use, such that an individual with limited hand use may still be able to withdraw the inner casing from the outer casing. The lock disengagement may include a cut-out in a surface of panel of the outer casing. The lock disengagement may provide a surface area for a user to press inward on. By pressing downward on the lock disengagement, pressure may be applied to the locking tab such that the tab moves inward toward the center of the container. By pressing downward on the lock disengagement, pressure may be applied to the locking tab such it can be distanced from the locking layer and thereby may be able to bypass the locking layer as force is applied to the inner casing to withdrawn the inner casing from the outer casing. The lock disengagement may include a cut-out in a surface of panel of the outer casing. The cut-out may be located adjacent to the locking layer on the same surface, side, or panel of the as the locking layer. For example, the cut-out may be located adjacent the back end of the locking layer. The cut-out may be located in between the locking layer and the lock disengagement surface. The cut-out may allow inward pressure to be applied to the same surface the locking layer is located on without having inward pressure applied to the locking layer. The cut-out may allow only a portion of the outer casing's surface to deform inward from pressure. For example, the cut-out may restrict pressure from traveling across the entire surface to which the pressure is applied to. By placing the cut-out adjacent to the locking layer on the same surface, when applying pressure on the side of the cut-out furthest from the locking layer's back end, the outer casing's surface may be temporarily deformed thereby temporarily deforming a surface of the inner casing. By deforming a surface of the inner casing, the locking tab is distanced away from the surface of the outer casing having the locking layer. By placing the cut-out adjacent to the locking layer on the same surface, the locking layer remains in a substantially steady position instead of also deforming inward, which may allow distance to form between the locking tab and locking layer. The distance formed between the locking layer and locking tab may allow the locking tab to move past the locking layer which may allow the inner casing to be withdrawn from the outer casing.

The container may comprise a retention feature. The retention feature may be any feature that retains the inner casing partially within the outer casing. The retention feature can be located on the exterior surface of the inner casing, the interior surface of the outer casing, or a combination of both. The retention feature may be any feature that does not prevent the lock disengagement from disengaging the locking tab from the locking layer and permitting the inner casing from being withdrawn from the outer casing. The retention feature may restrict how far the inner casing may be withdrawn from the outer casing, such that the inner casing is not completely withdrawn from the outer casing during normal use.

The casings may include one or more lateral projections that project from a lateral peripheral edge of a side wall layer, an edge of the top surface, and/or an edge of the bottom surface. Such projections may be a tab or other feature capable of orienting in a direction so that it forms either part of or substantially a side wall, more than one side wall, or part of a layer of a side all. A lateral projection may provide reinforcement to a side wall. A lateral projection may provide reinforcement for a corner.

The container may include an adhesive for attaching some or all of a face of a blank to a surface of the same blank. For example, adhesive may be employed for attaching a blank's panel to another panel. Adhesive may be employed for closing a casing. Adhesive may be employed for attaching a feature to a blank. For example, adhesive may be used for affixing the locking layer to the outer casing. Further, adhesive may be used to affix a locking tab to the inner casing. Adhesive may be used to affix printed material, such as medical information, on the exterior surface(s) of the casing(s). The adhesive may be provided to one or both of the faces to be attached. The adhesive may be selected to provide a durable adhesion to the surfaces being attach. The adhesive may be characterized as a glue, a curable adhesive, a non-polar adhesive, a reactive adhesive, an adhesive that covalently bonds to a surface, an adhesive that bonds to a surface with van der Waals forces, or any combination thereof. The adhesive may be provided on the entirety of a surface or on a portion of a surface. For example, the adhesive may be provided as a pattern on a surface, a uniform layer, irregularly, along a periphery of a surface, or any combination thereof.

At least one or more surfaces of the blank, may be adapted for printing directly on its surface. Preferably at least one of the exterior facing surfaces of the outer casing is adapted for printing directly on its surface. Preferably at least one of the exterior facing surface of the inner casing is adapted for printing directly on its surface. When a blank is folded into a casing, it may include a show surface. The show surface may be the blank's exterior facing surface which is visible after folding. For example, two layers of one surface may each have an exterior facing surface, but only one layer will be visible on a casing's exterior to result in a show surface. When folded into a casing, the blank may have hidden surfaces. For example, surfaces of a layer that have been covered by another layer. When folded into a casing, preferably none of the hidden surface is visible. Nevertheless, it may be advantageous to have printing on a hidden surface so that instructions or other features may be provided on that surface. It is also possible to fold the continuous sheet and/or employ openings is a sheet so that portions of both faces are visible.

The blank may be formed of any material or combination of materials capable of being folded to form multiple layers of the casing's components, such as multiple layers of walls.

The blank may have a first face and a second face. The thickness of each blank may be the distance between the two opposing faces. The thickness may be uniform or it may vary. Preferably each blank has a thickness that is sufficiently uniform so that it can be made from stock materials (e.g., card stock, sheet stock, or cardboard) or other material having generally uniform materials. As used herein, a sheet having a uniform thickness has a thickness with a standard deviation of about 205 or less, about 10% or less, about 5% or less, or about 15 or less. For example, the standard deviation of the thickness may be about 0%.

Each blank may be formed by die cutting a sheet stock material. As such, the blank, may be die cut preform for a container. Any material suitable for folding, die cutting, or both may be employed. The blank may be a single layered material or may have multiple layers. For example, the blank may include a layer of a polymer, a layer of a paper, a corrugated medium, or any combination. A particularly preferred material is a paperboard. Another particularly preferred material is cardboard. Any paperboard or cardboard may be employed. A combination of two or more materials may be employed. The inner casing blank and the outer casing blank may be comprised of the same material or different materials. The thickness of the material is preferably about 0.1 mm to about 5 mm, and more preferably 0.2 mm to about 3 mm. The thickness of the material is preferably sufficiently high so that each casing can be assembled without having to fold an excessive number of layers for each surface. As an example, if the blank material includes a paperboard, the paperboard may be characterized as about 8 point, 10 point, about 12 point, about 14 point, about 16 point, about 18 point, about 20 point, about 22 point, about 24 point, or about 26 point, about 28 point, about 30 point, or about 32 point. As another example, if the blank material includes a cardboard, the cardboard may be characterized as single face board, single wall board, double wall board, or even triple wall board. If the blank material includes a cardboard, the cardboard may be characterized as C-Flute, B-Flute, E-Flute, F-Flute, or R-Flute.

Each casing may include any number of layers, top surface layers, bottom surface layers, and/or side wall. For example, the bottom surface or top surface of either or both the inner casing and outer casing may be partially comprised or substantially comprised of a plurality of layers. For example, one or more of the side walls of either or both the inner casing and outer casing may be partially comprised or substantially comprised of a plurality of layers. The layers may be formed from multiple panels of the blank. If a single layer may have insufficient strength to support the container, by using a plurality of stacked layers, a container having sufficient strength may be achieved. Layers may be used to provide additional features of the inner or outer casing, for example, by layering the panels on a side wall, the locking layer may be formed. Each side wall may have the same number of side wall layers or may differ in the number of side wall layers.

The components described in the teachings herein may be used for preparing a container having a generally polygonal base with n sides, where n is 3 or more. Containers that are employed having a box compartment often have n=4 sides. As such, the teachings focus on such containers, more particularly having rectangular bases. However, it should be appreciated the teachings herein can also be applied to containers having different number of sides, having one or more sides that is not parallel to another side, having an even number of sides, or having an odd number of sides, or having one or more sides with a length differing from one or all of the other sides, or any combination thereof. The base of the container may generally be thought of as being positioned on a horizontal plane. The base may be generally flat. However, the base may be formed to have minor amounts of curvature. The container generally has upright side walls rising vertically from the base portion. The height of the upright side walls will generally be uniform for a given upright side and constant between the upright side walls. However, containers in which one or more upright side walls vary in height and/or in which one or more side walls have a height that is different from the height of an opposing upright side wall may also be employed. By way of example, a container may include a generally rectangular base having four side walls, including a first side wall with a first height, an opposing side wall having a second height (e.g., greater than the first height), and adjacent side walls that vary in height (e.g., between the first height and the second height).

The disclosure further relates to a method of forming the container according to the teachings herein. The method may comprise: folding a first blank along a plurality of fold lines to form a plurality of walls which project orthogonally from a plurality of edges along a perimeter of the container's top surface and bottom surface; applying adhesive to one or more surfaces of the first blank; folding a second blank along a plurality of fold lines to form a plurality of walls which project orthogonally from a plurality of edges along a perimeter of the container's top surface and bottom surface; applying adhesive to one or more surfaces of the first blank; forming an outer casing from the first blank; forming an inner casing from the second blank; and inserting the inner casing into the outer casing.

FIG. 1 is an isometric view of an illustrative container 10 in a three-dimensional and closed configuration 30. The container 10 may include an inner casing 12 which may be held within an outer casing 14. The inner casing 12 may be generally rectangular and include a back end 26. The outer casing 14 may be generally rectangular and include a back end 28. In the closed configuration, the inner casing 12 back end 26 may be adjacent to and in direct planar contact with the outer casing's 14 back end 28. The inner casing 12 may be sized such that it can retract in and out of the outer casing 14. The outer casing 14 may include a locking layer 16 located on the outer casing's 14 interior surface (not shown). The locking layer 16 may include a back end 17, which may be the surface of the locking layer 16 closest to the outer casing 14 back end 28. The inner casing 18 may include a locking tab 18 located on the inner casing's exterior surface (not shown). The locking tab may include a front end 19, which may be the surface of the locking tab 18 closest to the inner casing 12 front end 34 (not shown). The back end 17 of the locking layer 16 may restrict movement of the inner casing 12. For example, the back end 17 of the locking layer 16 may impede forward movement of the locking tab 18 by abutting with the front end 19 of the locking tab 18.

Figure 2:
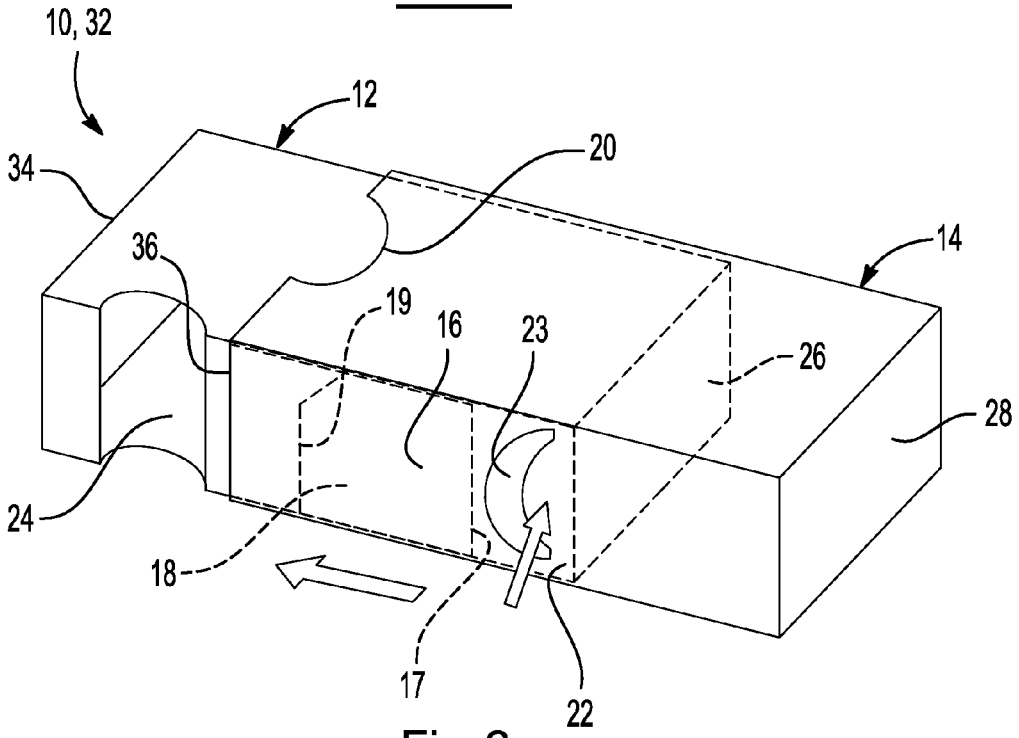
FIG. 2 is an isometric view of a container in accordance with the present teachings.

FIG. 2 is an isometric view of an illustrative container 10 in a three-dimensional and open configuration 32. The inner casing 12 may have a front end 34 opposite the back end 26. The outer casing 14 may have a front end 36 opposite its back end 28. The inner casing 12 may be able to be withdrawn from the outer casing 14, such as the inner casing 12 front end 34 withdrawing from the outer casing 14 front end 36. The outer casing 14 may include one or more access cutouts or contours 20 to provide access to the inner casing 12 when it is fully seated in the outer casing 14 (such as in FIG. 1). The outer casing 14 may include a lock disengagement 22, 23. The lock disengagement 22, 23 may be part of a panel or sidewall of the outer casing. The lock disengagement 22, 23 may include a press surface 22 and a cutout 23. The lock disengagement 22, 23 may provide a means for the locking tab 18 front end 19 to overcome the locking layer 16 back end 17. For example, by pressing the lock disengage surface 23, the locking tab 18 may be able to move past the locking layer 16 which may then allow the inner casing 12 to be withdrawn from the outer casing 14. The inner casing may include a dispensing aperture 24. In the closed configuration 30 (such as in FIG. 1), the dispensing aperture 24 may not visible nor may there be access into the interior of the inner casing 12. In the open configuration 32, the inner casing 12 may be able to be withdrawn sufficiently enough that the dispensing aperture 24 is visible and accessible.

Figure 3:
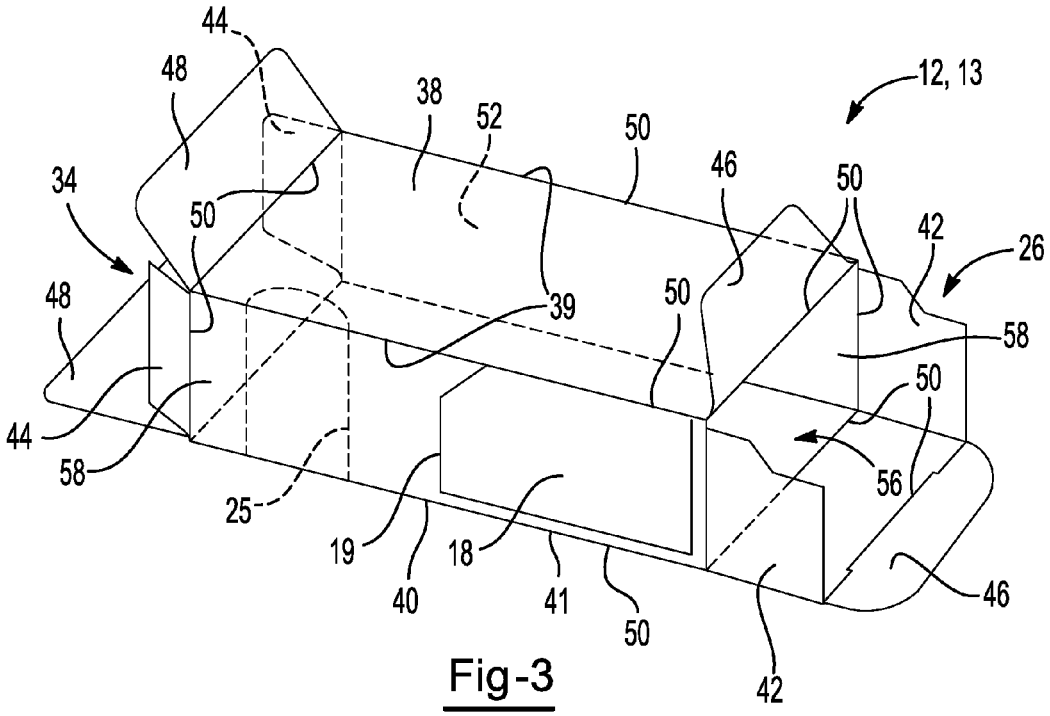
FIG. 3 is an isometric view of an inner casing of a container in accordance with the present teachings.

FIG. 3 is an isometric view of an illustrative inner casing 12 according to the teachings herein. The inner casing 12 may be generally rectangular with planar surfaces. The inner casing may include a top surface 38. The top surface 38 may be distanced from the bottom surface 40. Both the top surface 38 and the bottom surface 40 may include peripheral edges 39, 41 around their perimeter. The inner casing 12 may include a pair of lateral side walls 58. The lateral side walls 58 may project orthogonally from peripheral edges 39, 41 of the top surface 38 and bottom surface 40. The pair of lateral side walls 58 may be distanced from and parallel to one another. The interior 56 of the inner casing 12 may be hollow. The inner casing 12 may be constructed from a blank 13. The blank 13 may be a single continuous sheet. The blank 13 may include a plurality of fold lines 50 to guide folding of the blank 13 to form the inner casing 12. The inner casing 12 may have surfaces or walls with multiple layers. For example, the blank 13 may be folded such that one panel 52 overlaps with another panel or surface 38 to create multiple layers. Adhesive may be placed on a face of either or both panels to have retain the planar contact. The inner casing 12 may include lateral projections 42, 44, 46, 48. The lateral projections may be integrally connected to one or more surfaces of the inner casing 12, such as by extending from fold lines 50 located at lateral edges of side walls and/or peripheral edges of the top and bottom surfaces. The inner casing 12 may include lateral projections 42, 44 from the pair of lateral side walls 58. The lateral projections 42 may be located at the lateral edges of the lateral side walls (not shown). The lateral projections 42 may be located at the front end, the back end, or both. The inner casing 12 may include lateral projections 46, 48 from the top surface and the bottom surface. The lateral projections 46, 48 may be located at the peripheral edges 39, 41 of the top surface and bottom surface located at the front end and back end of the inner casing. The inner casing 12 may include a locking tab 18 integrally connected to a surface of the inner casing, such as the top surface 38. The locking tab 18 may be hingedly connected to the top surface with a fold line 50. The fold line 50 may permit the locking tab to be folded such that it is in planar contact with a surface of the inner casing 12, such as the exterior surface of a side wall 58. The inner casing may include perforations 25. The perforations 25 may be pierced to remove a portion of one or more surfaces of the inner casing 12. For example, by removing the perforated section 25, a portion of the top surface 38, bottom surface 40, side wall 58 or combination thereof may be removed. By removing the perforated section 25, the dispense aperture 24 (as shown in FIG. 2) may be formed on at least one surface of the inner casing 12.

Figure 4:
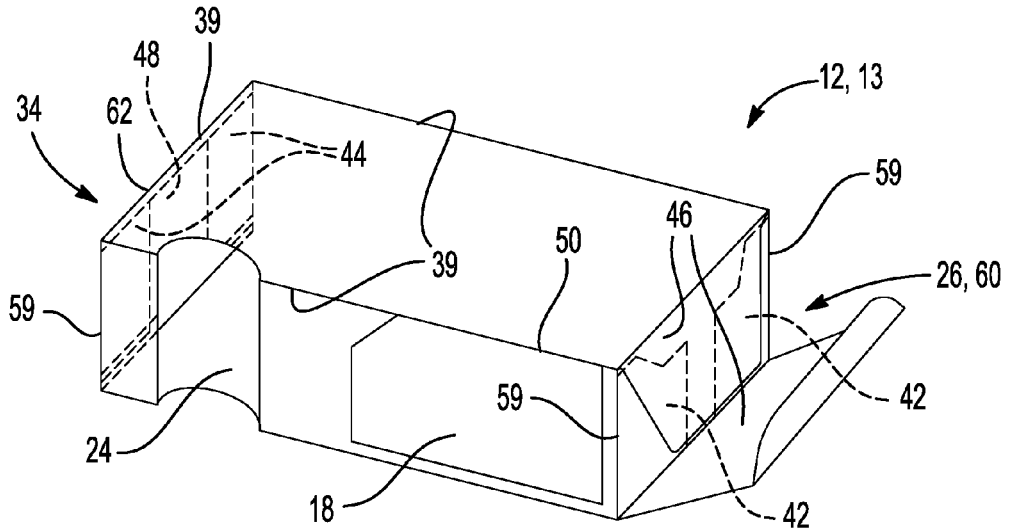
FIG. 4 is an isometric view of an inner casing of a container in accordance with the present teachings.

FIG. 4 is an isometric view of an illustrative inner casing 12 according to the teachings herein. The inner casing may include a dispense aperture 24. One or more of the lateral projections 42, 44 may be folded such that they project orthogonally from a lateral edge 59 of a lateral side wall 58. One or more lateral projections 46, 48 may be folded such that they project orthogonally from a peripheral edge 39, 41 of the top surface 38 or bottom surface 40. One or more lateral projections 42, 44, 46, 48 may comprise a portion of or a substantial portion of a side wall. For example, one or more of the lateral projections 42, 46 at the rear end 26 may be folded to form the back end side wall 60. For example, one or more of the lateral projections 44, 48 at the front end 34 may be folded to form the front end side wall 62. Adhesive may be applied to one or more surfaces or faces of one or more lateral projections to sustain their position as the front end side wall, the rear end side wall, or both. Adhesive may be used to prevent access into the inner casing, such as by maintaining a plurality of lateral projections adhered to other surfaces to form a back end side wall and/or a front end side wall.

Figure 5:
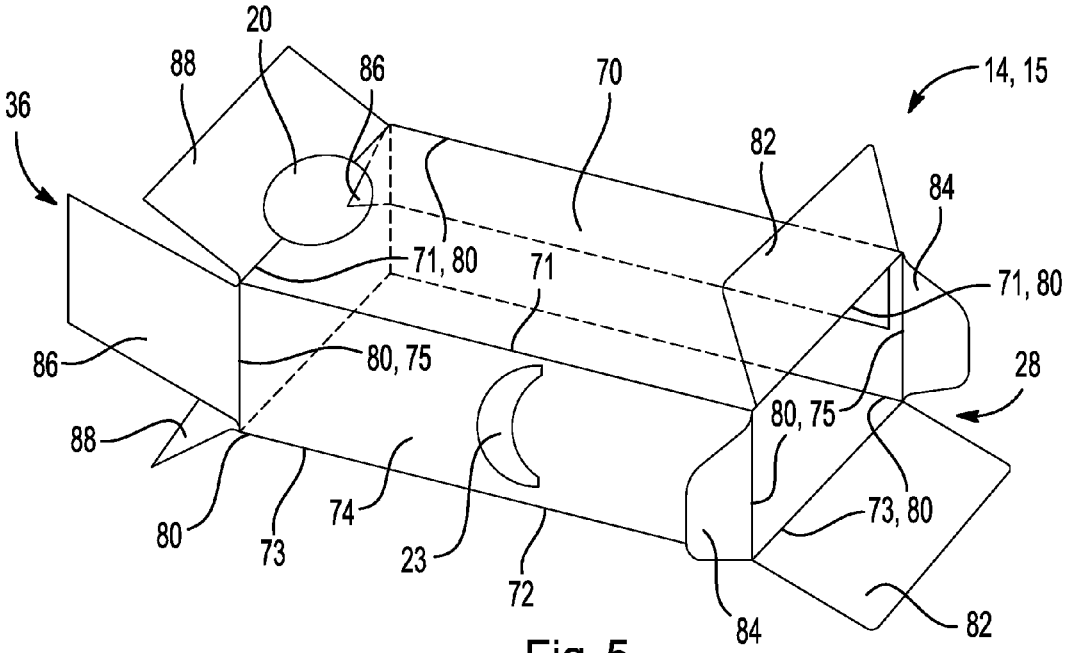
FIG. 5 is an isometric view of an outer casing of a container in accordance with the present teachings.

FIG. 5 is an isometric view of an illustrative outer casing 14 according to the teachings herein. The outer casing 14 may be generally rectangular with planar surfaces. The outer casing may include a top surface 70. The top surface 70 may be distanced from the bottom surface 72. Both the top surface 70 and the bottom surface 72 may include peripheral edges 71, 73 around their perimeters. The outer casing 14 may include a pair of lateral side walls 74. The lateral side walls 74 may project orthogonally from peripheral edges 71, 73 of the top surface 70 and bottom surface 72. The pair of lateral side walls 74 may be distanced from and parallel to one another. The outer casing 14 may be constructed of a blank 15. The blank 15 may include a plurality of fold lines 80 which may guide folding of the blank 15 to form the outer casing 14. The outer casing 14 may include lateral projections 82, 84, 86, 88. The lateral projections may be integrally connected to one or more surfaces of the outer casing, such as by extending from fold lines 80 located at the lateral edges 75 of side walls and/or peripheral edges 71, 73 of the top and bottom surfaces 70, 72. The outer casing 14 may include lateral projections 84, 86 projecting from the pair of lateral side walls 74. The lateral projections 84, 86 may be included at the front end 36, the back end 28, or both. The outer casing 14 may include lateral projections 82, 88 from the top surface 70 and the bottom surface 72. The lateral projections 84, 86 may be located at the peripheral edges 71, 73 of the top surface 70 and bottom surface 72 located at the front end 36 and back end 28 of the outer casing 14. The outer casing may include one or more cutouts 20 in one of its surfaces. The cutout 20 may be in both a surface and a lateral projection. For example, the cutout 20 may be on the top surface 70 and in a lateral projection 88 integrally connected to the top surface 70. The cutout 20 may be located at a fold line 86. After a lateral projection is folded, the cutout 20 may form a contoured edge (not shown) along a peripheral edge 71, 73 or lateral edge 75 of the outer casing 14. The cutout 20 may provide access to any material placed within the outer casing 14, such as an inner casing 12 (not shown). The outer casing 14 may include a lock disengage cutout 23. The lock disengage cutout 23 may be located on a surface of the outer casing 14. For example, the lock disengage may be located on the top surface 70, the bottom surface 72, a side surface 74, or a combination thereof. Preferably, the lock disengage cutout 23 is located on the same panel in which a locking layer 16 (not shown) of the outer casing 14 is located. The lock disengage cutout 23 may be any shape that prevents pressure applied to a portion of a surface from transferring to the locking layer 16.

Figure 6:
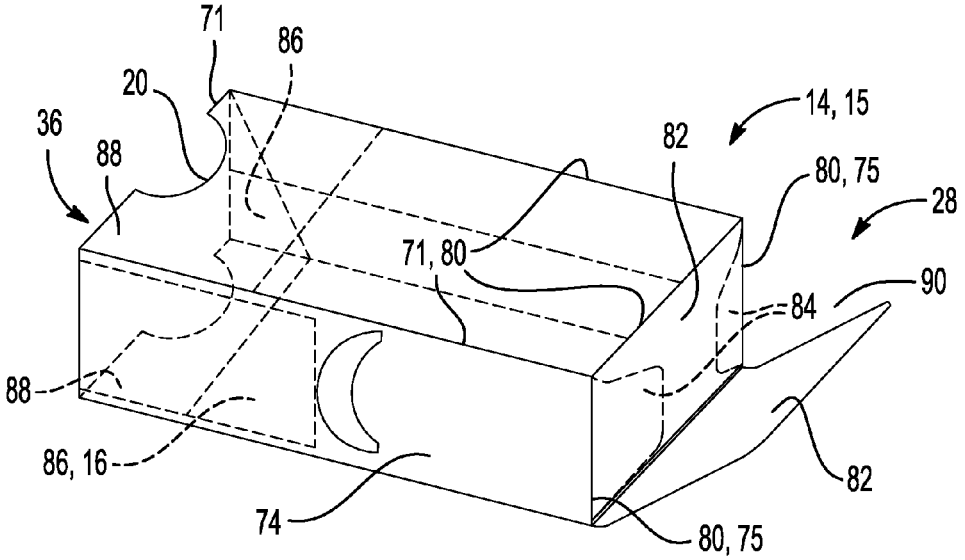
FIG. 6 is an isometric view of an outer casing of a container in accordance with the present teachings.

FIG. 6 is an isometric view of an illustrative outer casing 14 according to the teachings herein. One or more lateral projections 84 may be folded at a fold line 80 such that they project orthogonally from a lateral edge 75 of a side wall 74. One or more lateral projections 82 may be folded at a fold line 80 such that they project orthogonally from a peripheral edge 71, 73 of the top surface 70 or bottom surface 72. One or more lateral projections 82, 84 may comprise a portion of or a substantial portion of a wall 74, 90 or surface 70, 72. For example, one or more of the lateral projections 82, 84 at the rear end may be folded to form the back end side wall 90. For example, one or more lateral projections 86, 88 at the front end 36 may be folded to form a separate layer of a side wall 74, the top surface 70, the bottom surface 72, or a combination thereof. Adhesive may be applied to one or more surfaces of one or more lateral projections to sustain their position as the back end side wall. Adhesive may be applied to one or more lateral projections to prevent access into the outer casing. One or more of the lateral projections 86 may comprise part of the locking layer 16.

Figure 7:
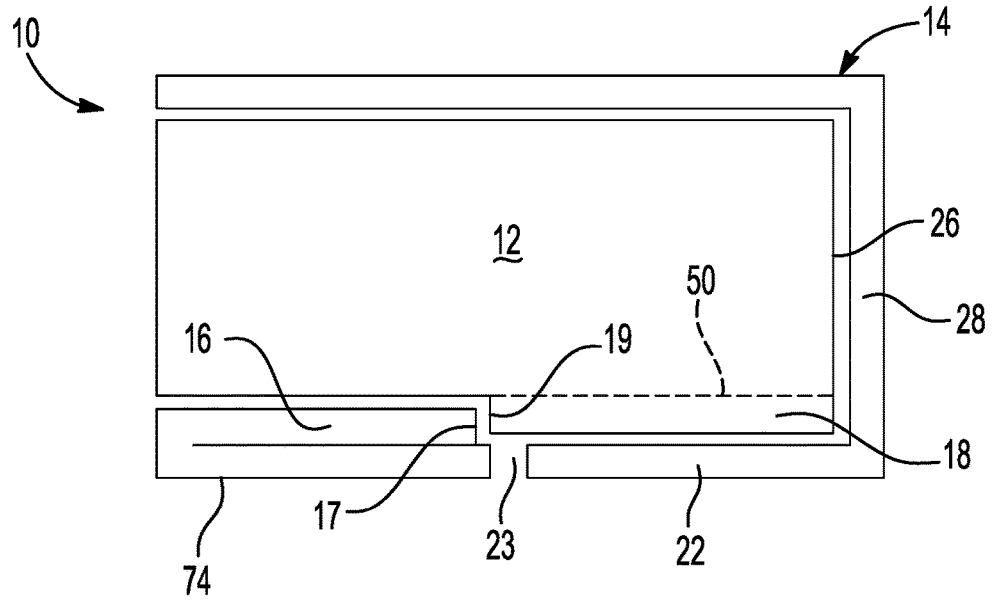
FIG. 7 is a cross-sectional view of the container in accordance with the present teachings.

FIG. 7 is a cross-sectional view of an illustrative container 10 according to the teachings herein. The inner casing 12 may be retracted within the outer casing 14. The inner casing 12 exterior surface at the back end 26 may be adjacent to and in contact with the outer casing 14 exterior surface at the back end 28. The locking layer 16 may be adjacent to the locking tab 18. For example, the locking layer 16 back end 17 may be adjacent to the locking layer 18 front end 17. The locking layer 16 back end 17 may prevent the inner casing 14 from being withdrawn from the outer casing 12. For example, the locking layer 16 back end 17 may restrict the locking tab 18 front end 19 from moving forward. The outer casing may include a lock disengage cutout 23. The lock disengage cutout 23 may be located on any surface or panel of the outer casing 14. Preferably, the lock disengage cutout 23 is located on the same side surface 74 as the locking layer 16. The lock disengage cutout 23 may be located adjacent to the locking layer 16. For example, the lock disengage cutout 23 may be adjacent to the locking layer 16 back end 17. The lock disengage cutout 23 may be located adjacent to a portion of the locking tab 18. A lock disengage press surface 22 may be located on the same surface 74 as both the locking layer 16 and lock disengage cutout 23. Preferably, the lock disengage press surface 22 is located on the side of the cutout 23 opposite the locking layer 16. The lock disengage press surface 22 may have a face adjacent to an exterior face or surface of the inner casing 12 when the inner casing 12 is fully retracted within the outer casing 14.

Figure 8:
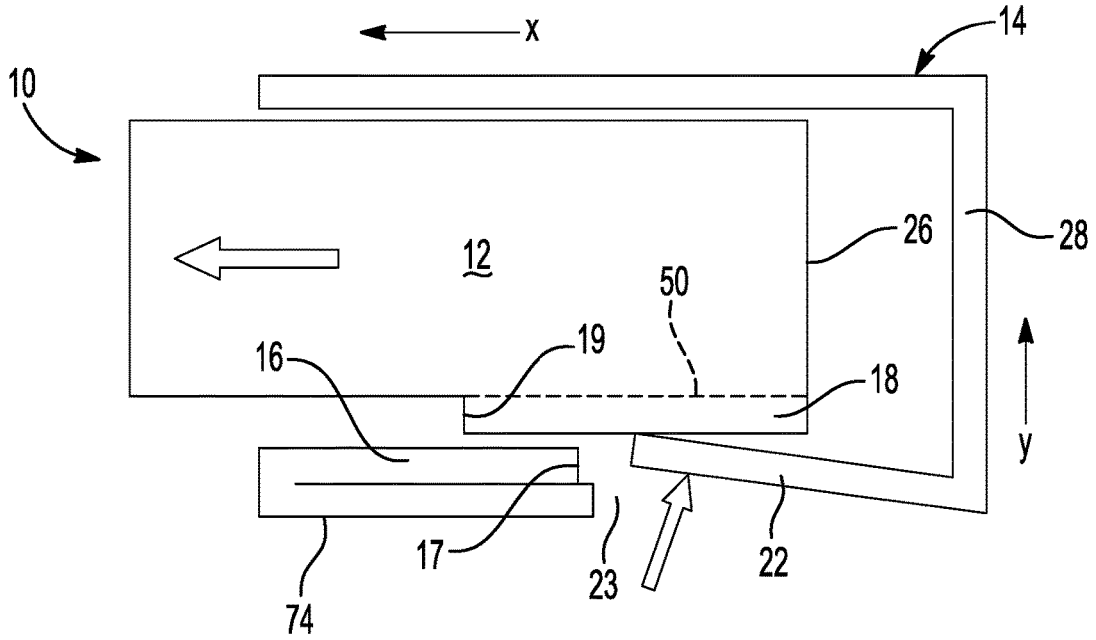
FIG. 8 is a cross-sectional view of the container in accordance with the present teachings.

FIG. 8 is a cross-sectional view of a container 10 according to the teachings herein. By pressing on the lock disengage surface 22, the inner casing 12 locking tab is distanced away from the locking layer 16 in the Y direction. The lock disengage cutout 23 may allow a force to be applied to a surface 74 of the outer casing, such as the lock disengage surface 22, to allow only a portion of the surface 74 to deform inward. For example, the side of the cutout 23, such as the lock disengage surface 22 may be deformed inward from the pressure but the cutout may restrict the force from reaching the surface on the opposing side of the cutout 23, such as where the locking layer 16 is located. As the locking tab 18 is able to be distanced away from the locking layer 16 in the Y direction, the inner casing 12 may be able to be withdrawn from the outer casing 14 in the X direction.

Figure 9:
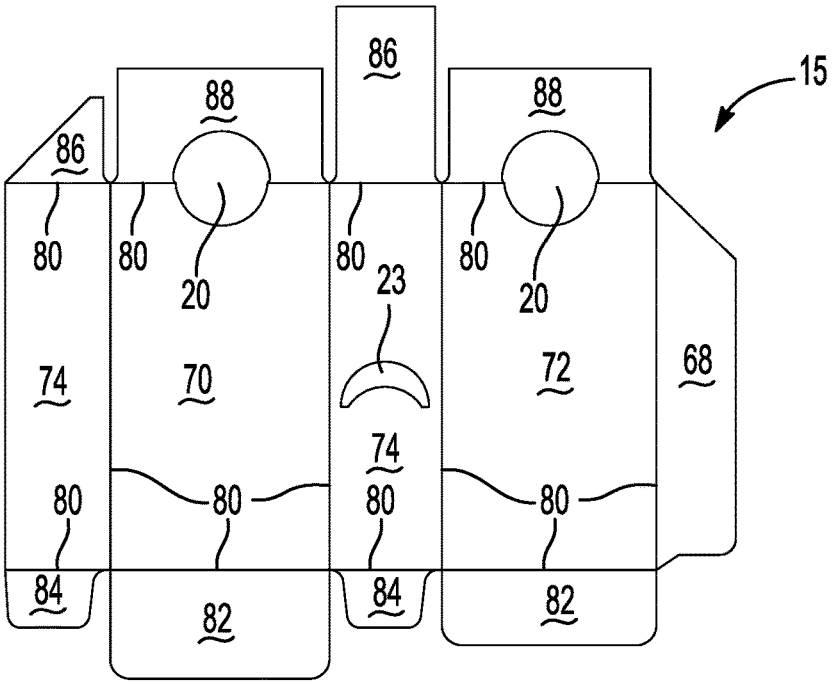
FIG. 9 is a plan view of a continuous sheet of an outer casing according to the teachings herein.

FIG. 9 is a plan view of an illustrative blank 15 to form an outer casing 14 according to the teachings herein. The blank 15 may include a first surface and a second surface. The first surface may be the hidden surface when the blank has been folded to form the outer casing. The second surface may be an exposed surface or show surface when the blank 15 has been folded to form the outer casing 14. The blank 15 may include a plurality of fold lines 80. The fold lines 80 may divide the blank into panels. The panels may form the portions or substantial portions of surfaces and sides of the outer casing 14, such as the top surface 70, bottom surface 72, or side walls 74. Some of the panels of the blank 15 may be lateral projections, such as side wall lateral projections 42, 44 and top and bottom surface lateral projections 46, 48. The panels may provide additional support to the surfaces or walls of the outer casing 14. A panel overlapping with another panel may have adhesive applied onto a surface to maintain the three-dimensional configuration of the outer casing one it is formed. For example, a panel such as the inner panel 68 may overlap with another panel, such as a lateral side wall 74 when the outer casing is formed. Adhesive may be applied on either the inner panel 68 or the lateral side wall 74 to maintain the overlapping contact. The blank may include cutouts 20, 23 or perforations.

Figure 10:
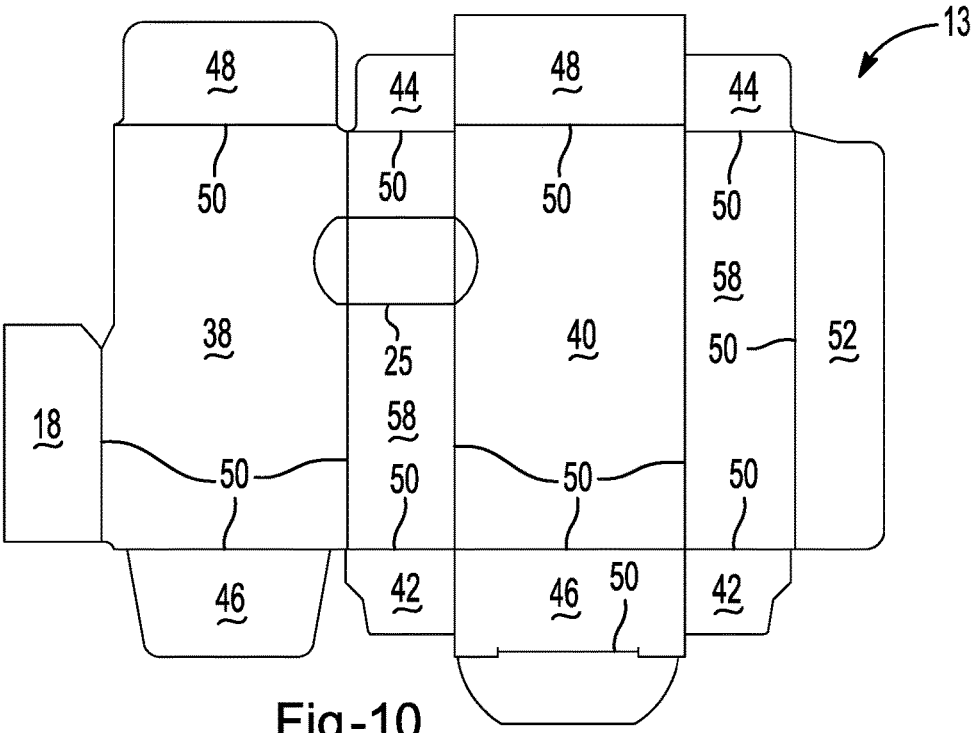
FIG. 10 is a plan view of a continuous sheet of an inner casing according to the teachings herein.

FIG. 10 is a plan view of an illustrative blank 13 to form an inner casing 12 according to the teachings herein. The blank 13 may include a first surface and a second surface. The first surface may be the hidden surface when the blank has been folded to form the inner casing. The second surface may be an exposed surface or show surface when the blank has been folded to form the inner casing. The blank 13 may include a plurality of fold lines 50 that divide the blank into panels. The panels may form the surfaces of the inner casing 12, such as the top surface 38, bottom surface 40, or side walls 58. Some of the panels of the blank 13 may be lateral projections, such as side wall lateral projections 42, 44 and top and bottom surface lateral projections 46, 48. The panels may provide additional support or to the surfaces or walls of the inner casing. A panel overlapping with another panel may have adhesive applied onto a surface to maintain the three-dimensional configuration of the inner casing one it is formed. For example, a panel such as the inner panel 52 may overlap with another panel, such as the top surface 38 when the inner casing is formed. Adhesive may be applied on either the inner panel 52 or the top surface 38 to maintain the overlapping contact. The blank may include cutouts or perforations 25.

Though not necessarily drawn to scale, all geometries relative proportions and dimensions shown in the drawings are also part of the teachings herein, even if not explicitly recited. However, unless otherwise noted, nothing shall limit the teachings herein to the geometries, relative proportions, and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A container comprising:

a) an outer casing, the outer casing comprising a locking layer that is folded into planar contact with an inside surface of the outer casing, the outer casing comprising a press surface;

b) an inner casing, which is received within die outer casing and is retractable from within the outer casing, the inner casing includes a locking tab, the locking tab is folded into planar contact with an outside surface of the inner casing;

wherein when the inner casing is fully received within the outer casing, the locking tab is adapted to engage the locking layer of the outer casing to prevent the inner casing from being withdrawn from the outer casing;

wherein when the press surface of the outer casing is deformed, the locking tab is distanced away from the locking layer so that the inner casing can be withdrawn from the outer casing;

wherein the container comprises a dispense aperture and a lock disengagement cutout; and wherein the dispense aperture, the lock disengagement cutout, the locking layer, and the locking tab are all located on a same side of the container.

2. The container of claim 1, wherein the outer casing is formed of a first single continuous sheet; and the inner casing is formed of a second single continuous sheet, and wherein both the first single continuous sheet and the second continuous sheet each include a plurality of fold lines.

3. The container of claim 2, wherein the inner casing includes a plurality of surfaces, including a top surface and a bottom surface connected by a plurality of side walls; and the top surface, the bottom surface, and the plurality of side walls are each formed by a panel of the second continuous sheet.

4. The container of claim 3, wherein the dispense aperture is formed in one of the side walls of the inner casing, which allows material within the inner casing to be dispensed, and wherein the dispense aperture is exposed from within the outer casing only after the press surface of the outer casing is deformed and a surface of the inner casing is deformed so that the locking tab is distanced away from the locking layer so that the inner casing can be withdrawn from the outer casing.

5. The container of claim 2, wherein the outer casing includes a plurality of surfaces, including a top surface and a bottom surface connected by a plurality of side walls; and the top surface, the bottom surface, and the plurality of side walls are each formed by a panel of the first continuous sheet.

6. The container of claim 2, wherein the inner casing includes a plurality of closure flaps formed by panels of the second continuous sheet.

7. The container of claim 2, wherein the outer casing includes a plurality of closure flaps formed by panels of the first continuous sheet.

8. The container of claim 1, wherein the locking tab is hingedly connected at a fold line to a surface of the inner casing.

9. The container of claim 1, wherein the outer casing includes at least one access contour on at least one outer casing surface, which provides access to the inner casing when the inner casing is retained within the outer casing.

10. The container of claim 1, wherein the outer casing includes a lock disengagement located on at least one outer casing surface, which disengages the locking tab from the locking layer.

11. The container of claim 10, wherein the lock disengagement includes the lock disengagement cutout, wherein the lock disengagement cutout is located adjacent a back end of the locking layer, wherein when the inner casing is fully received within the outer casing, the back end of the locking layer is adapted to engage a front end of the locking tab to prevent the inner casing from being withdrawn from the outer casing.

12. The container of claim 1, at least one surface of the inner casing includes perforations which allow a section of the inner casing to be removed to form the dispense aperture.

13. The container of claim 1, wherein the inner casing contains pharmaceutical products.

14. The container of claim 1, wherein when the inner casing is fully received in the outer casing, an edge of the locking tab is adapted to directly contact an edge of the locking layer.

15. The container of claim 1, wherein after the inner casing is fully received within the outer casing, the inner casing is moveable relative to the outer casing only after the locking tab is distanced away from the locking layer.

16. The container of claim 1, wherein the lock disengagement cutout is located adjacent an end of the locking layer so that the locking layer remains in a substantially steady position instead of deforming inwardly when the press surface of the outer surface is deformed.

17. The container of claim 1, wherein after the press surface of the outer casing is deformed, a surface of the inner casing is deformed so that the locking tab is distanced away from the locking layer.

18. A container comprising:

a) an outer casing, the outer casing comprising a locking layer that is folded into planar contact with an inside surface of the outer casing, the outer casing comprising a press surface and a lock disengagement cutout;

b) an inner casing, the inner casing includes a locking tab, an entire surface of the locking tab is folded into planar contact with an outside surface of the inner casing;

wherein after the inner casing is fully received within the outer casing, the back end of the locking layer is adapted to engage a front end of the locking tab to prevent the inner casing from being withdrawn from the outer casing, wherein after the press surface of the outer casing is deformed, the locking tab is distanced away from the locking layer so that the inner casing can be withdrawn from the outer casing, wherein the lock disengagement cutout is located adjacent the back end of the locking layer so that the locking layer remains in a substantially steady position instead of deforming inward after the press surface of the outer surface is deformed, wherein the container comprises a dispense aperture, and the dispense aperture, the lock disengagement cutout, the locking layer, and the locking tab are all located on a same side of the container.

19. The container of claim 18, wherein after the press surface of the outer casing is deformed, a surface of the inner casing is deformed so that the locking tab is distanced away from the locking layer.

* * * * *